US006110022A

United States Patent [19]

Ciccone et al.

[11] Patent Number: 6,110,022

[45] Date of Patent: Aug. 29, 2000

[54] DEVICE FOR OBTAINING SAFETY STAMPS APPLICABLE TO PAPER OR OTHER LAMINAR ELEMENTS

[76] Inventors: Nicolas Tadeo Ciccone; Héctor Hugo Ciccone, both of Irogoyen 417/19, (1407), Buenos Aires, Argentina

[21] Appl. No.: 09/111,274

[22] Filed: Jul. 7, 1998

[30] Foreign Application Priority Data

Jul. 14, 1997 [AR] Argentina ..... P 97 01 13151

[51] Int. Cl.[7] ..... B24B 49/04

[52] U.S. Cl. ..... 451/178; 451/51; 451/246

[58] Field of Search ..... 451/51, 189, 242, 451/246, 254, 178, 388, 398

[56] References Cited

U.S. PATENT DOCUMENTS

| | | | |
|---|---|---|---|
| 3,258,804 | 7/1966 | Fowle | 451/242 X |
| 3,280,512 | 10/1966 | Seidel | 451/242 X |
| 4,052,822 | 10/1977 | Obear | 451/246 X |
| 4,480,412 | 11/1984 | Shank et al. | 451/246 X |
| 4,656,789 | 4/1987 | Schwar | 451/246 |

*Primary Examiner*—David A. Scherbel
*Assistant Examiner*—Anthony Ojini
*Attorney, Agent, or Firm*—Staas & Halsey LLP

[57] ABSTRACT

Device for obtaining safety stamps applicable to paper or other laminar elements. Said device comprises a supporting cylinder (a) for paper (3) fitted with reliefs (5) separated from an abrasive periphery (2') wheel (b) along a distance that is shorter than the height of said relief (5) peaks (5); the device includes antisliding pressure means (c) and adjustment means (d) for applying the paper (3) to the cylinder (a) side walls (1'), in addition to angular drive means (15) in said supporting cylinder (a). In view that the distance separating the abrasive wheel (b) from the supporting cylinder (a) is shorter than the height of the relief (5) peaks (5') when the relief (5) enters the contact zone, the abrasive periphery (2') of the wheel (b) abrades the ends of said peaks (5'), resulting in a water mark being implemented. The antisliding pressure means (c) secure the paper (3) in place, while the adjustment means (d) preclude any paper (3) maladjustment in the critical abrasion zone.

14 Claims, 4 Drawing Sheets

DEVICE FOR OBTAINING SAFETY STAMPS APPLICABLE TO PAPER OR OTHER LAMINAR ELEMENTS

DESCRIPTION

The present invention relates to a device for obtaining safety stamps applicable to paper or other laminar elements, the object being to produce a so-called "water mark" by partially abrading the reliefs or low-reliefs of the paper on which the stamp is applied.

It is known in the paper industry that certain batches are provided with a safety stamp referred to as a water mark. Traditionally, these water marks have been used as a safety means for the printing of large-volume, high-cost documents and forms, such as the issuing of banknotes. These marks are furthermore applied as an indication of the high quality of the marked paper.

Traditionally, the devices for forming these water marks have consisted in auxiliary equipment for paper laminating machines, comprising stamping dies and stereotypes designed to increase the laminator thicknesses in the laminate area to be marked.

This means that stamping dies and their assembly and adjustment means are part of the paper-making machine and form an auxiliary means thereof. Applying these means causes the paper pulp to be altered as it passes the laminators, so that the paper thickness is reduced in the stamping area and a relief of the stamping die is obtained. The reduced thickness of the stamping area creates a transparency effect not evident in the rest of the paper, the water mark becoming thus defined.

Since these devices require setting-up modifications in the paper-producing machine, stamping is limited to large production volumes as a result of the high costs involved.

Subsequently, however, Argentine invention patent No. 240.422, owned by the holders of this invention, contributed a new procedure for producing safety stamps through a device based on a stamping die supporting cylinder and an abrasive wheel.

This stamping device offers an improvement, as compared to traditional stamping devices, in that it allows small productions to be performed at a reasonable cost without affecting the paper manufacturing process in view that stamping is implemented through a device that is independent from the paper rolling machine.

However, certain drawbacks are evident, such as the difficulty in managing a proper adjustment of the paper against the stamping cylinder. In fact, the cylinder stamping dies separate the paper from the cylinder side walls and thus facilitate its movement in respect to the cylinder on which it lies.

Furthermore, this spacing between the paper and the cylinder allows for the eventual formation of paper plies in the sector adjacent the contact area between the abrasion means and the stamping cylinder. In addition to this, minor maladjustments, unforeseen offsetting or paper tearing may cause the abrasive means to contact and damage the cylinder stamping dies.

All the above inconveniences are satisfactorily solved by the device of the present invention. It should first of all be stated that this is not a device designed to form paper reliefs, since separate means are provided for this purpose which are either flat or rotating, e.g. a stamping cylinder which presses the paper against a surface carrying the stamping dies.

The present device comprises a supporting cylinder for the paper on which the reliefs have already been stamped.

This supporting cylinder is spaced apart from an abrasive peripheric wheel by a distance that is shorter than the peak heights of the relief. It also comprises an antisliding pressure device, a means of adjusting the paper against the side walls of the cylinder, and a supporting cylinder angular drive means.

On rotation of the supporting cylinder, the movement retaining pressure device fixes the position of the paper, said device comprising brushes the filiform bundles of which exert pressure so that an intimate contact is attained between the cylinder side walls and the back side of the paper, thus impairing the paper's displacement.

Adjacent the contact zone, between the abrasive wheel and the cylinder, the adjustment means precludes the offsetting of the paper in the critical abrasive zone. In the various forms of embodiment foreseen, both the micro holes communicating with a vacuum chamber and the compressed air ejected from blower peaks secure the paper against the cylinder while the suction mouth removes all nature of impurities from the contact area.

Finally, in view that the distance separating the abrasive wheel from the supporting cylinder is shorter than the height of the relief peaks, and as the latter enter the contact zone, the wheel's abrasive periphery abrades the peak tips and produces the water mark, avoiding the inconveniences deriving, as previously stated, from known devices.

DRAWINGS

For further clarity and understanding of the object of the invention, several figures are provided depicting one of the preferred forms of embodiment for illustrative, non-limiting purposes.

FIG. 1 is a schematic cross-section of the present device. It shows the abrasive periphery of the wheel, in addition to the arrangement of the antisliding pressure brush. Shown nearer the contact zone between the cylinder and the abrasive wheel, the paper adjustment means are seen to comprise a motor compressor connected to blower nozzle complemented by a brush and a suction mouth.

In the various figures, the same reference numbers identify equal or corresponding parts; letters are used to designate different element assemblies.

Figure 1:
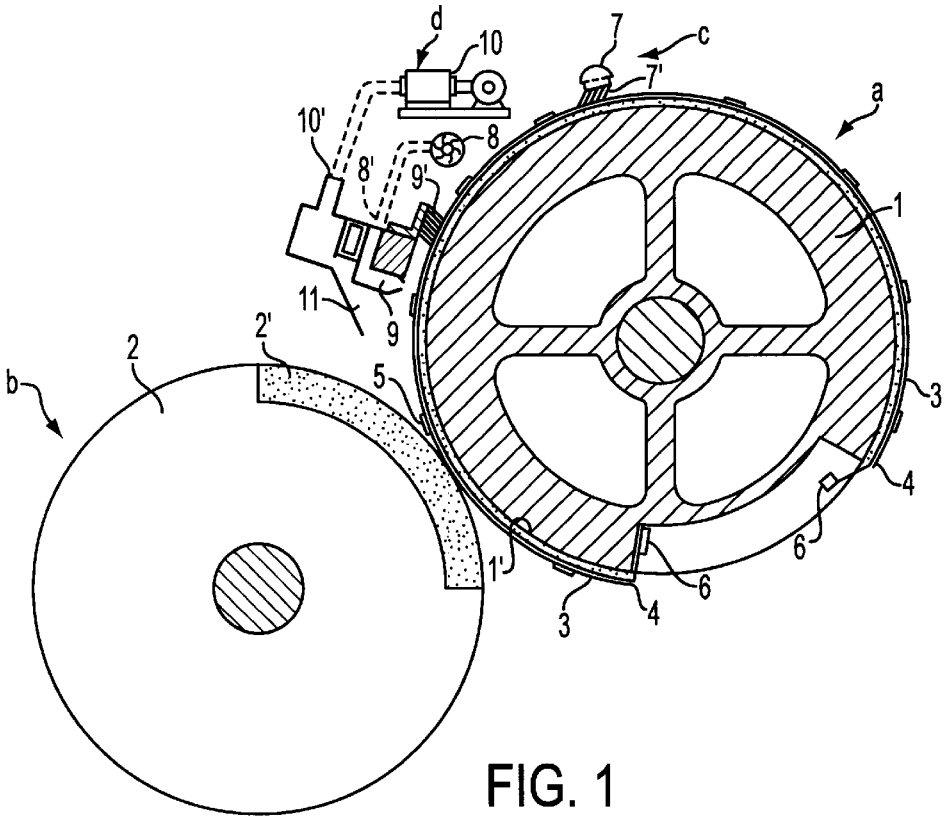
Figure 2:
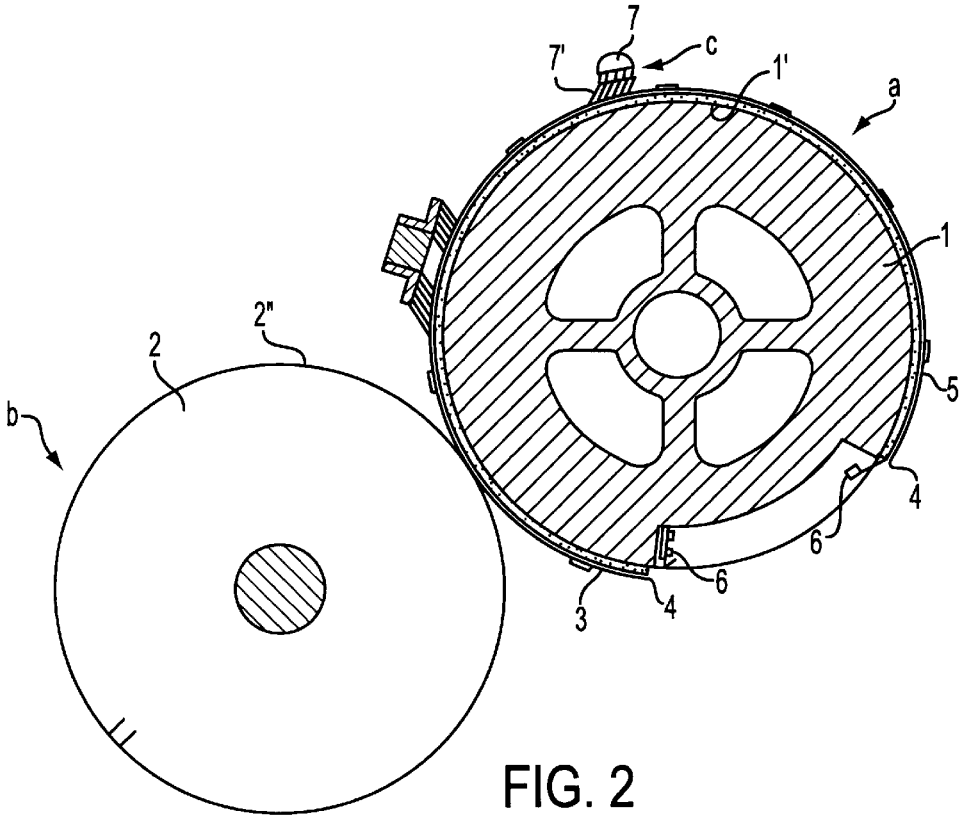
FIG. 2 is another cross-section, in which the adjustment means comprise a double brush fitted with an adjustment mechanism (not shown) controlled by a pneumatic circuit.
Figure 3:
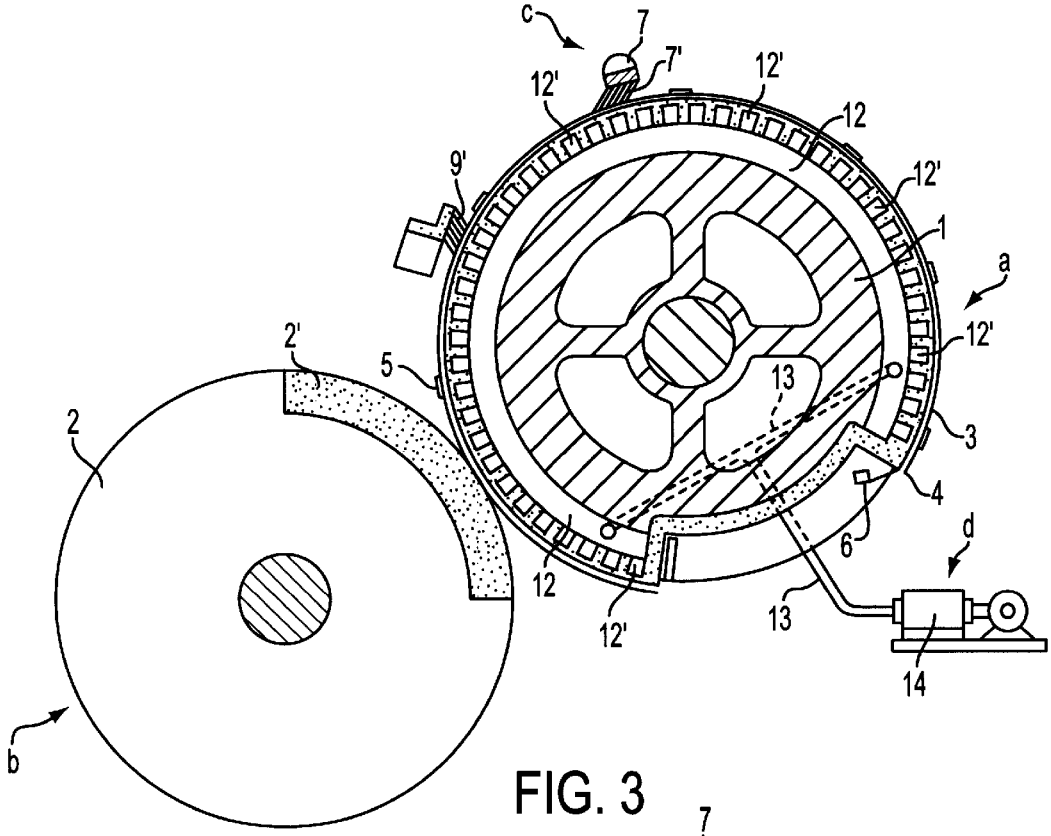
FIG. 3 is a further cross-section, in which the adjustment means comprise micro holes which perforate the cylinder's side walls. A pneumatic chamber connected to a vacuum pump can be seen inside the cylinder.
Figure 4:
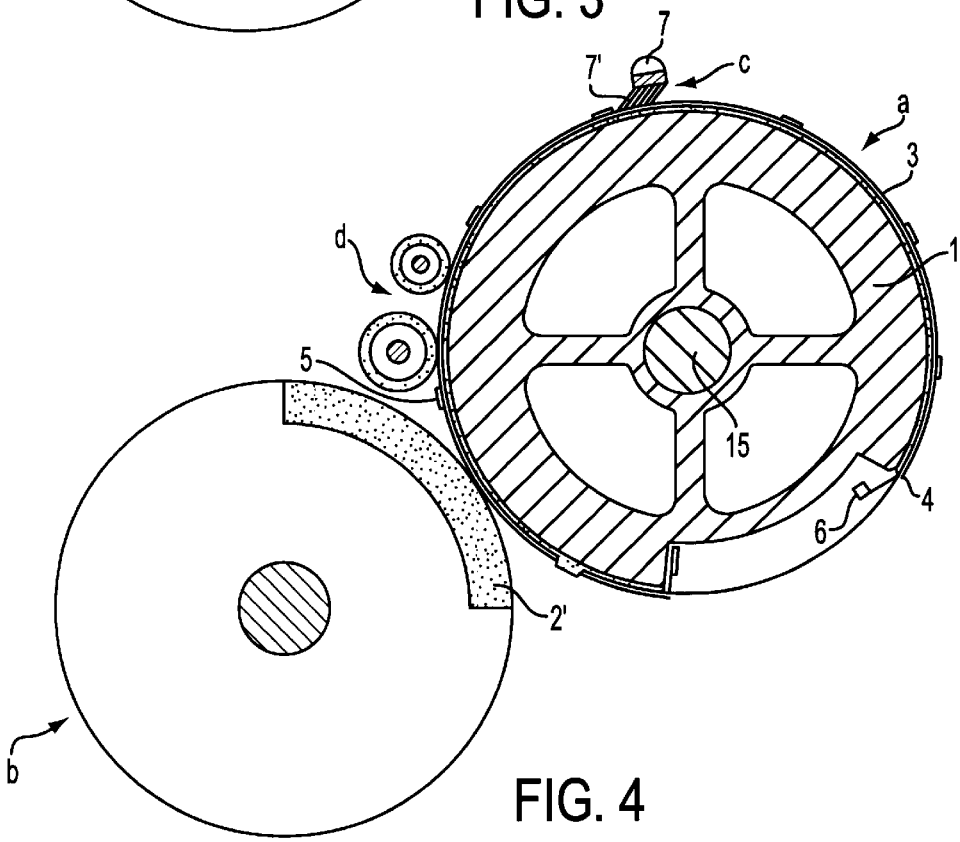
FIG. 4 illustrates another form of embodiment, in which the adjustment means comprise pneumatically adjustable pressure rollers.

List of the main references:

| | |
|---|---|
| (a) | paper supporting cylinder |
| (b) | abrasive wheel |
| (c) | antisliding pressure means |
| (d) | paper adjustment means |
| (1) | supporting cylinder (a) body |
| (1') | supporting cylinder (a) body |
| (2) | abrasive wheel (b) body |
| (2') | abrasive wheel (2) periphery |
| (2") | replaceable sandpaper |
| (3) | application paper |
| (3') | paper (3) front side |
| (3") | paper (3) back side |
| (4) | paper (3) ends |
| (5) | paper (3) reliefs or low-reliefs |
| (5') | relief (6) peaks |
| (6) | end (4) of paper (3) position attachment means |
| (7) | antisliding pressure brushes |
| (7') | brush (7) filiform bundles |
| (8) | motor compressor |
| (8') | compressed air line |
| (9) | blower nozzle |
| (9') | adjustment brush |
| (10) | suction pump |
| (10') | suction line |
| (11) | suction mouth |
| (12) | cylinder (a) pneumatic vacuum chamber |
| (12') | side wall (1') pass-though micro holes |
| (13) | pneumatic suction lines |
| (14) | vacuum pump |
| (15) | supporting cylinder (a) shaft means (connected to angular drive means in cylinder (a)) |
| (16) | first adjuster roller |
| (16') | second adjuster roller |
| (17) | relief stamping dies |
| (17') | low-relief stamping dies |
| (18) | stamping cylinder |

MAIN OBJECT

On the basis of the above specified objects, this invention refers to a device for obtaining safety stamps applicable to paper (3) or other laminar elements, of the type designed to form water marks on paper (3) reliefs or low-reliefs (5)—by lowering the paper's thickness through partial abrading of the peaks (5') of said reliefs or low-reliefs (5)—produced by stamping dies (17), said device being characteristic in that it comprises:

a) a paper (3) supporting cylinder (a), the paper being applied to the cylinder side walls (1') through end (4) position attachment means (6) arranged on the cylinder (a) proper;

b) an abrasive periphery (2') wheel (b) connected to rotating drive means and arranged adjacent the supporting cylinder (a), from which it is separated by a distance that is shorter than the relief (5) peak (5') heights;

c) paper (3) adjusting means (d)—over the surface of side walls (1') of supporting cylinder (a)—comprised in a pneumatic circuit and arranged at least adjacent the zone between the supporting cylinder (a) and the abrasive wheel (b);

d) paper (3) antisliding pressure means (c) extending against the cylinder (1') side walls; and e) supporting cylinder (15) angle drive means.

DESCRIPTION

The present device for obtaining safety stamps applicable to paper (3) or other laminar elements is designed to produce water marks in reliefs or low-reliefs (5) on application paper (3) by reducing the thickness of said paper (3) through a partial abrading of the relief (5) peaks (5').

Generally speaking, this device comprises a supporting cylinder (a) for the paper (3) with reliefs (5) spaced apart from an abrasive periphery (2') wheel (b) by a distance that is shorter than the peak (5') heights of said relief (5); the device including antisliding pressure means (c) and paper (5) adjustment means (d) against the cylinder (a) side walls (1'), in addition to angular drive means (15) fitted on said supporting cylinder (a). See FIGS. 1, 2, 3 and 4.

More specifically, the device of the present invention comprises an application paper (3) supporting cylinder (a). The paper (3) is applied on the side walls (1') of cylinder (a) body (1) in a manner that its ends (4) become secured by position attachment means (6) located in the body (1) proper of cylinder (a). See FIG. 1.

Figure 6A:
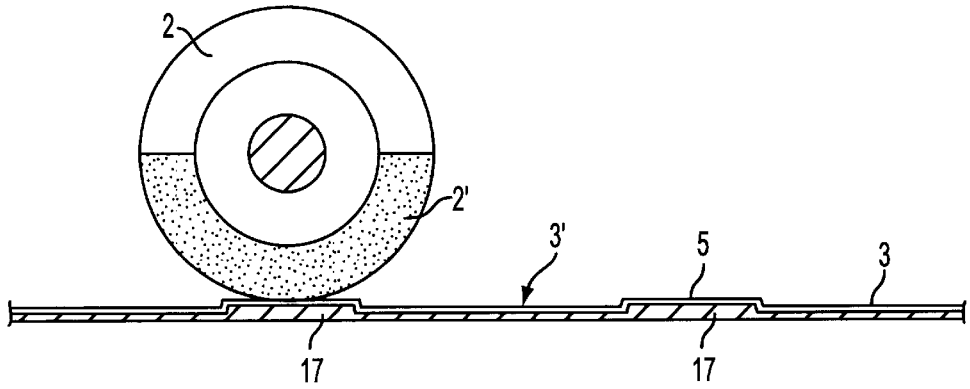
FIG. 6A is a schematic side view illustrating the operational principle of the known device shown in FIG. 5.
Figure 6B:
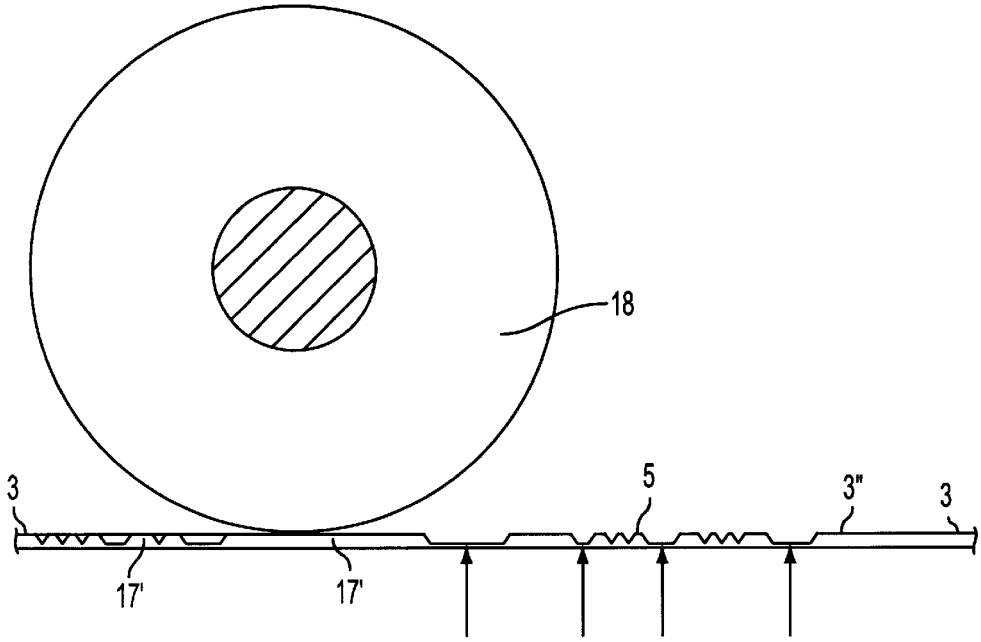
FIG. 6B is a chematic side view illustrating the stamping operation performed by a device based on a cylinder and a stamped surface. It reveals the manner in which the cylinder operates on the back side of the paper.
Figure 6C:
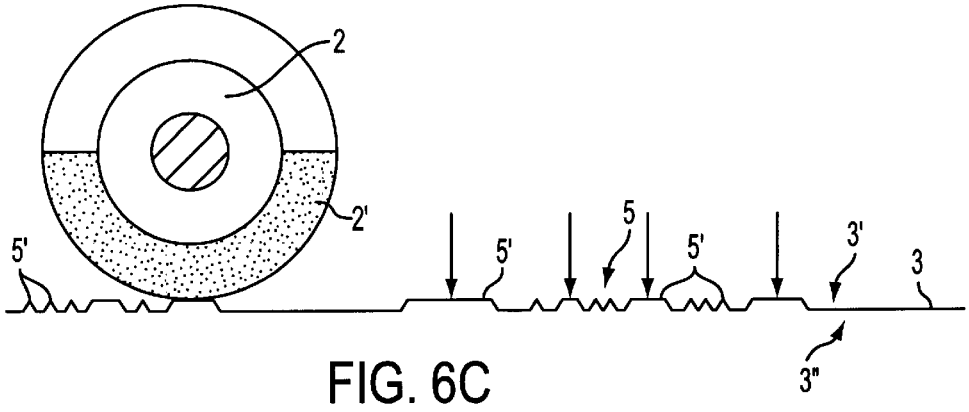
FIG. 6C is a schematic side view illustrating the operation of the cylinder used in the device of the present invention. It reveals the manner in which the abrasive periphery of the wheel abrades the tips of the relief peaks.

Adjacent the supporting cylinder (a) is a wheel (b) fitted with an abrasive periphery (2') connected to rotating drive means. This abrasive wheel (b) is spaced apart from the cylinder (a) by a distance that is shorter than the relief (5) peaks (5') formed on the paper (3). See FIGS. 1 and 6*c*.

In the various forms of embodiment, the abrasive periphery (2') wheel (b) body (2) may be an abrasive stone or a drum the cylindrical periphery (2') of which faces the supporting cylinder (a) side walls (1'). This drum is fitted with replaceable sandpaper (2") covering said periphery (2'). See FIG. 2.

Furthermore, and adjacent the zone between the supporting cylinder (a) and the abrasive wheel (b), are provided paper (3) adjusting means (d). Said adjusting means (d), comprised within a pneumatic circuit, adjust the paper (3) against the supporting cylinder (a) side wall (1') surface.

In a form of embodiment, said adjustment means (d) consist in a pneumatic circuit comprising a motor compressor (8) and a compressed air container. Said container is fitted with a feeding nozzle forming a pressure fluid outlet connected to a compressed air line (8') associated to a blower nozzle (9). The latter (9) is fitted with an ejection mouth facing the paper (3) and directed toward the contact zone between said paper (3) and abrasive wheel (b). See FIG. 1.

Based on this same principle, another form is foreseen wherein the compressed air line (8') is connected to one or two blower nozzles (9), each of which has its mouth arranged adjacent the contact zone between the paper (3) and the abrasive wheel (b), which in turn faces one of the paper (3) edges and flushingly projects air thereon.

In another possible embodiment, the paper (3) adjusting means (d) consists of a pneumatic circuit comprising a motor compressor (8) connected through a corresponding line (8') to a blower nozzle (9), the ejection mouth of which faces the paper (3). Adjacent said blower nozzle (9) is a suction mouth (11) connected through a respective line (10') to a suction pump (10) and oriented toward the contact zone between the paper (3) and the abrasive periphery (2') wheel (b). Adjacent blower nozzle (9) and suction mouth (11) a complementary adjustment brush (9') is installed. See FIG. 1.

Also foreseen are variants wherein the paper (3) adjustment means (d) comprise elements such as brushes (9') or cylinders (16, 16') variably adjustable against the supporting cylinder (a) side walls (1'). In order to allow for adjustment variations, a pneumatic forward-reverse adjustment mechanism (not shown) is included. See FIGS. 2 and 4.

Another form of embodiment foreseen comprises an adjustment means (d) comprising a pneumatic circuit composed of a pneumatic chamber (12) and a vacuum pump (14). According to this variation, a pneumatic chamber (12) is formed within the supporting cylinder (a) body (1) itself, its suction entry taking the form of a nozzle connected to a pneumatic network, the suction outlet being fitted with a plurality of micro holes (12') which perforate the cylinder (a) side walls (1'), distributed throughout the cylinder's usable peripheric surface. The chamber (12) entry is connected to a vacuum pump (14) via a vacuum line (13). See FIG. 3.

The device of the present invention further comprises paper (3') antisliding pressure means (c). In a preferred form of embodiment, said antisliding pressure means (c) consist of brushes (7) the filiform bundles (7') of which project against the cylinder (a) side walls (1'). Concerning their location, the antisliding pressure brushes (7) are arranged adjacent the paper (3) adjustment means (d) and preceding the rotation direction of the supporting cylinder (a). Also foreseen is the possibility of arranging a plurality of pressure brushes (7) distributed throughout the periphery of said supporting cylinder (a). See FIGS. 1 to 4.

In other possible forms of embodiment, the paper (3) antisliding pressure means (c) may be formed by rollers, the periphery of which roll over the periphery of the supporting cylinder (a).

The device of the present invention is completed with angular drive means (15) for said paper (3) supporting cylinder (a).

Figure 5:
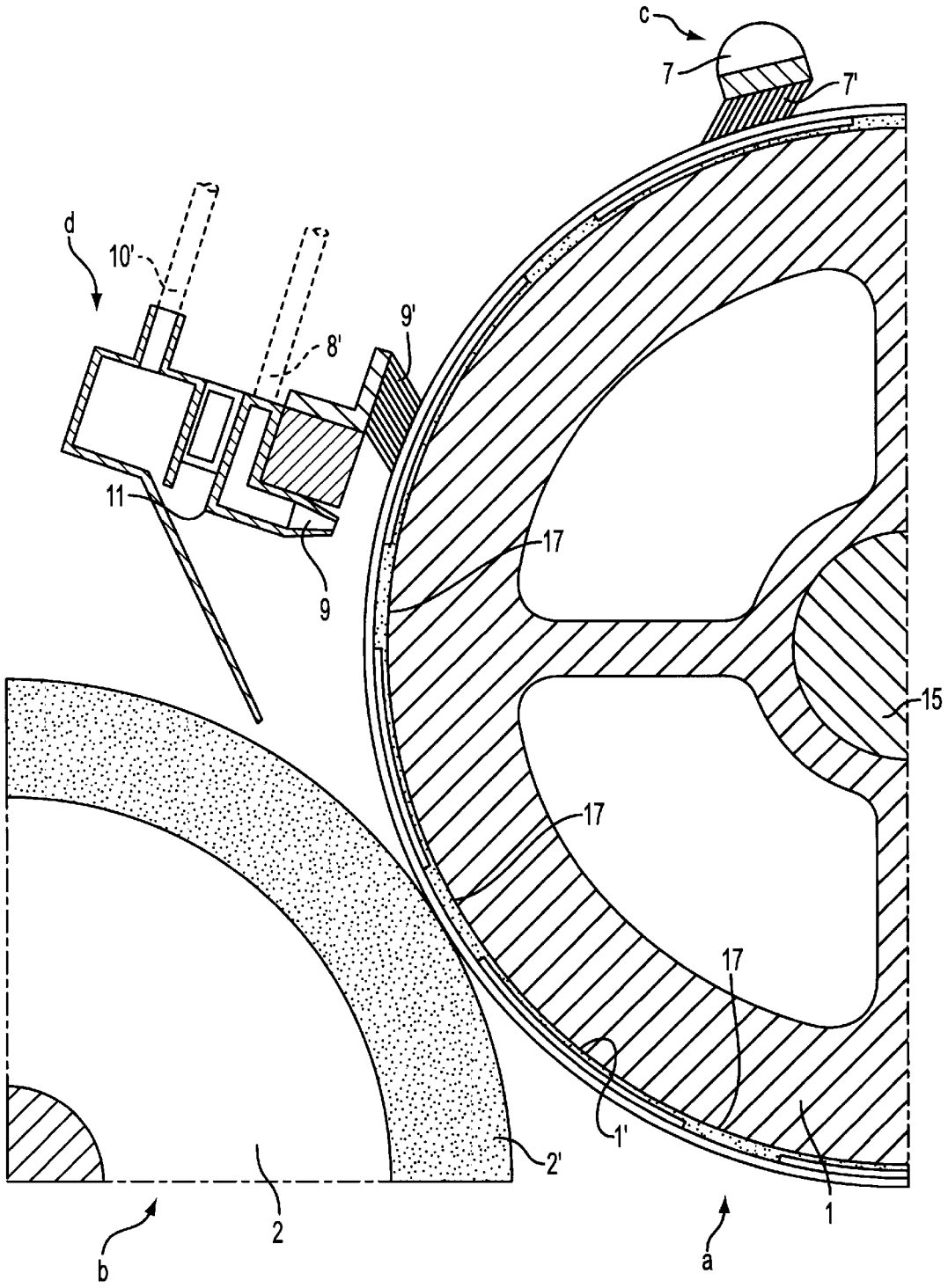
FIG. 5 is a cross-section of a prior art device. For the purpose of illustrating this, part of the means used by the present invention (paper antisliding and adjustment means) have been added, said means failing to remove the gap between the paper and the cylinder because of the presence of the stamping dies.

Operation of the device is as follows:

In the closest exponent of the state of the art, the relief (5) stamping dies (17) are arranged along the cylinder (a) side walls (1'). Merely adding some of the means used in the present invention (as depicted in FIG. 5) would fail to solve the problems stated herein.

Initial preparation of the paper (3) by submitting it to the relief and low-relief (5) stamping cylinders (18) and stamping dies (17') allows for conditioning and arrangement of the paper (3) in the present device. In fact, once the paper (3) has passed between the stamping cylinder (18) and the stamping dies (17'), a relief (5) is formed, including peaks (5') on the paper (3) back side (3"). See FIG. 6*b*.

Thus, the paper (3) is arranged over the cylinder (a) side walls (1') so that the paper's back side (3") rests against said side walls (11) and the front side (3') is exposed for treatment. The paper (3) ends (4) are attached to the cylinder (a) through position attachment means (6) fitted in the cylinder (a).

On rotation of the supporting cylinder (a), the brushes (7) forming the movement retaining pressure means (c) fix the position of the paper (3) as a result of the filiform bundles (7') exerting pressure, so that intimate contact between said cylinder (a) side walls (1') and the back side (3") of the paper (3) is obtained, thus impairing movement of the paper.

Adjacent the contact zone, between the abrasive wheel (b) and the cylinder (a), the adjustment means (d) preclude the offsetting of the paper (3) in the critical abrasive zone. Concerning the blower nozzle (9), the ejected compressed air adjusts the paper (3) against the cylinder (a), while the presence of the suction mouth (11) removes all nature of impurities from the contact area. See FIG. 1.

A similar adjustment effect is achieved by an embodiment wherein the adjustment means (d) comprise a pneumatic chamber (12) fitted with micro holes (12') which perforate the cylinder (a) side walls (1'). In this case, the action of the suction pump (14) through said chamber (12) and micro holes (12') maintains the paper applied against the supporting cylinder (a) side walls. See FIG. 3.

In view that the distance between the abrasive wheel (b) and the supporting cylinder (a) is shorter than the height of the relief (5) peaks (5'), once the relief (5) enters the contact zone the abrasive periphery (2') of wheel (b) abrades said peaks (5'), producing the water mark. See FIG. 6*c*.

Upon putting this invention to practical use, modifications can doubtless be introduced in regard to certain construction and forming details without departing from the fundamental principles clearly defined in the following claims.

What is claimed is:

1. Device for obtaining safety stamps on paper or other laminar elements through partial abrading of paper relief peaks formed by stamping dies, comprising:

a paper supporting cylinder having a supporting cylinder, cylinder side walls and a position attachment means arranged on the supporting cylinder, the paper being applied to the cylinder side walls through the position attachment means;

an abrasive periphery wheel rotatably arranged adjacent to the supporting cylinder and separated therefrom by a distance that is shorter than a height of the paper relief peaks;

paper adjustment means provided adjacent to a zone comprising the distance between said abrasive periphery wheel and the supporting cylinder and above a surface of the cylinder side walls for adjusting the paper against the surface of the cylinder side walls;

paper antisliding pressure means projecting against the cylinder side walls; and supporting cylinder angle drive means.

2. A device according to claim 1, wherein the paper anti-sliding pressure means comprises paper anti-sliding pressure brushes having filiform bundles which project against the cylinder side walls.

3. A device according to claim 1, wherein said paper adjustment means has a pneumatic circuit comprising:

a pneumatic vacuum chamber formed within the supporting cylinder, the pneumatic vacuum changer having a suction entry taking the form of a nozzle and a suction outlet being fitted with a plurality of micro holes which perforate the cylinder side walls and are distributed throughout a peripheric surface of the supporting cylinder, and a vacuum pump having a suction mouth which is connected to the suction entry.

4. A device according to claim 1, wherein said paper adjustment means has a pneumatic circuit comprising:

compressed air container means;

a motor compressor which, together with said compressed air container means, is fitted with a feeding nozzle forming a pressure fluid outlet; and at least one blower nozzle connected to said pressure fluid outlet and fitted with an ejection mouth facing the paper, directed toward a proximity of a contact zone between said paper and said abrasive periphery wheel.

5. A device according to claim 1, wherein said paper adjustment means comprises:

a motor compressor which has a feeding nozzle forming a pressure fluid outlet at an end of said motor compressor; and at least one blower nozzle connected to the pressure fluid outlet, fitted with a mouth arranged in proximity to a contact zone between said paper and said abrasive periphery wheel and facing an edge of said paper for flushingly projecting air thereon.

6. A device according to claim 1, wherein said paper adjustment means has a pneumatic circuit comprising:

a motor compressor having a feeding nozzle at one end forming a pressure fluid outlet;

at least one blower nozzle connected to the pressure fluid outlet and having an ejection mouth facing the paper;

a suction pump fitted with a connection nozzle forming an inlet for sucked-in air;

at least one suction mouth respectively adjacent to the at least one blower nozzle, the at least one suction mouth being connected to the suction pump connection nozzle and oriented toward a proximity of a contact zone between the paper and said abrasive periphery wheel; and adjustment brushes proximally arranged with respect to said at least one blower nozzle and suction mouth.

7. A device according to claim 1, wherein said paper adjustment means comprises variable adjustment brushes applied against the cylinder side walls.

8. A device according to claim 1, wherein said paper adjustment means comprises variable adjustment cylinders applied against the cylinder side walls.

9. A device according to claim 1, wherein said paper antisliding pressure means are brushes having filiform bundles which project against the cylinder side walls and are located at least adjacent to said paper adjustment means.

10. A device according to claim 1, wherein said paper antisliding pressure means are brushes having filiform bundles which project against the cylinder side walls and are distributed facing a periphery of said paper supporting cylinder.

11. A device according to claim 1, wherein said paper antisliding pressure means are rollers having peripheries which roll over a periphery of the paper supporting cylinder.

12. A device according to claim 1, wherein said abrasive periphery wheel is an abrasive stone.

13. A device according to claim 1, wherein said abrasive periphery wheel is a drum having a cylindrical periphery facing the cylinder side walls, the cylindrical periphery being covered with replaceable sandpaper.

14. A device according to claim 1, wherein said supporting cylinder is rotatable driven in a sequential manner involving angular fractions delimited by stations which correspond to a paper relief abrasive surface coincidence zone.

* * * * *